US007344816B2

(12) United States Patent
Matsumura et al.

(10) Patent No.: US 7,344,816 B2
(45) Date of Patent: Mar. 18, 2008

(54) IMAGE FORMING METHOD

(75) Inventors: Yasuo Matsumura, Kanagawa (JP); Tsukasa Matsuda, Kanagawa (JP); Kazuhiko Arai, Kanagawa (JP); Tetsuo Yamada, Kanagawa (JP)

(73) Assignee: Fuji Xerox Co., Ltd, Tokyo (JP)

( * ) Notice: Subject to any disclaimer, the term of this patent is extended or adjusted under 35 U.S.C. 154(b) by 301 days.

(21) Appl. No.: 10/940,926

(22) Filed: Sep. 15, 2004

(65) Prior Publication Data

US 2005/0142478 A1 Jun. 30, 2005

(30) Foreign Application Priority Data

Dec. 26, 2003 (JP) ..... 2003-435637

(51) Int. Cl.
*G03G 15/20* (2006.01)

(52) U.S. Cl. ..... 430/124.31; 430/111.4; 399/335

(58) Field of Classification Search ..... 430/124, 430/111.4, 124.31; 399/335
See application file for complete search history.

(56) References Cited

U.S. PATENT DOCUMENTS 6,936,390 B2 * 8/2005 Nanya et al. ..... 430/108.22
2002/0192587 A1 * 12/2002 Matsumura et al. ..... 430/110.4
2003/0043108 A1 * 3/2003 Iwase et al. ..... 345/107
2004/0081901 A1 * 4/2004 Egusa et al. ..... 430/45
2004/0137351 A1 * 7/2004 Sato ..... 430/108.8
2004/0152003 A1 * 8/2004 Sato et al. ..... 430/108.4

FOREIGN PATENT DOCUMENTS

JP 63-282752 A 11/1988
JP 06-250439 A 9/1994
JP 10-026842 A 1/1998
JP 2001-117268 A 4/2001
JP 2003-98736 A 4/2003

OTHER PUBLICATIONS

Jun Takagi; "On-Demand Full Color Digital Xerography Printing System [Color Docu Tech 60]"; Journal of the Imaging Society of Japan; vol. 40, No. 2; Apr. 14, 2001; pp. 37-41; Fuji Xerox Co., Ltd.

* cited by examiner

*Primary Examiner*—John L Goodrow
(74) *Attorney, Agent, or Firm*—Oliff & Berridge, PLC

(57) ABSTRACT

A method for forming an image contains steps of: transferring a toner having a volume average particle diameter of 5 μm or less to a recording medium as a toner image having a monochromatic maximum toner mass per area of 0.35 mg/cm$^2$ or less; and fixing the toner image at a surface temperature of a fixing roll which is 130° C. or less. The toner preferably has 0.02 log(Pa)/° C. or less of a gradient of a storage, elasticity per temperature in a temperature range of from Tm+20° C. to Tm+50° C. Here, Tm represents a melting temperature of a crystalline resin contained in the crystalline toner.

13 Claims, 3 Drawing Sheets

IMAGE FORMING METHOD

BACKGROUND OF THE INVENTION

1. Field of the Invention

The present invention relates to a method for forming an image by an electrophotographic method or an electrostatic recording method using a toner for developing an electrostatic image. More specifically, the invention relates to a method for forming an image suitable for graphic arts and short run printing.

2. Description of the Related Art

Such a method of visualizing image information through an electrostatic latent image as an electrophotographic method has been utilized in various fields including duplicators and printers associated with the progress of the technique thereof and the growth of the market.

In the electrophotographic method, an electrostatic latent image is formed on a photoreceptor through a charging step and an exposing step, and the electrostatic latent image is developed with a developer containing a toner and then visualized through a transferring step and a fixing step.

The developer used herein includes a two-component developer containing a toner and a carrier, and a one-component developer using a magnetic toner or a non-magnetic toner solely.

The toner is generally produced by a kneading and pulverizing method, in which a thermoplastic resin is mixed and kneaded with a pigment, a charge controlling agent, a releasing agent and the like, and after cooling the resulting mixture, it is pulverized and classified. Inorganic or organic particles may be added to the surface of the toner for improving the flowability and the cleaning property thereof depending on necessity. A toner produced by the ordinary kneading and pulverizing method has an irregular shape and an irregular surface structure, which are delicately changed depending on the pulverization property of the material used and the pulverization conditions, and therefore, the shape and the surface structure of the toner are difficult to be controlled intentionally. In the case where a material having high pulverization property is used, it often causes formation of further powder and changes in toner shape due to a mechanical force in a developing device. Due to the influences of these phenomena, in the two-component developer, the powder is fused to the surface of the carrier to accelerate charge deterioration of the developer. In the one-component developer, the particle size distribution is broadened to cause scattering of the toner, and the toner shape is changed to lower the developing property to cause deterioration in image quality.

In the case where a toner is internally added with a releasing agent, such as wax, the releasing agent is often exposed to the surface of the toner depending on the combination with the thermoplastic resin to exhibit influence. Particularly, in a combination of a resin that is slightly difficult to be pulverized by imparting elasticity with a high molecular weight component and a brittle wax releasing agent, such as polyethylene, polyethylene is often exposed to the surface of the toner. The phenomenon is advantageous in releasing property upon fixing and cleaning property of a non-transferred toner from a photoreceptor, but the polyethylene on the surface easily migrates by a mechanical force to contaminate a developer roll, a photoreceptor and a carrier, so as to bring about deterioration in reliability. Furthermore, the toner is insufficient in flowability due to the irregular shape thereof even by adding a flowability assistant, whereby particles on the surface of the toner migrate to recessed parts on the surface by a mechanical force during use to lower the flowability with the lapse of time, and the flowability assistant is buried in the toner to deteriorate the developing property, the transferring property and the cleaning property. Moreover, in the case where a toner recovered upon cleaning is returned and reused in the developing machine, deterioration in image quality is liable to occur. When the amount of the flowability assistant is increased to prevent these problems, other problems occur that black spots are formed on the photoreceptor, and the assistant particles are scattered.

In recent years, production processes of toners by an emulsion polymerization aggregation method have been proposed as a method for intentionally controlling the shape and the surface structure of the toner, as decribed in JP-A-63-282752 and JP-A-6-250439.

In the emulsion polymerization aggregation method, materials having been formed into particles having a diameter of 1 μm or less are generally used as starting materials, and therefore, a toner having a diameter of about from 1 to 25 μm can be theoretically produced. More specifically, in general, a resin dispersion liquid is formed by emulsion polymerization, and a colorant dispersion liquid having a colorant dispersed in a solvent is separately produced. The resin dispersion liquid and the colorant dispersion liquid are mixed to form aggregated particles having a diameter corresponding to a toner diameter, and thereafter, the aggregated particles are fused and integrated by heating to produce a toner. In this method, the toner surface has the same composition as the interior thereof, and it is difficult to control the surface composition intentionally.

In order to solve the problem, it has been proposed that the compositions over the inner layer to the surface layer are freely controlled even in the toner produced by the emulsion polymerization aggregation method to realize more accurate control of the particle structure as described in JP-A-10-26842. Furthermore, the inventors have proposed crystalline toners using a crystalline resin as a binder resin in JP-A-2001-117268 and JP-A-2003-98736. These toners can be easily reduced in diameter and realize accurate control of the particle structure, whereby the image quality is significantly improved in comparison to the conventional electrophotographic images, and simultaneously high reliability is expected.

In recent years, the image forming method by electrophotography using the aforementioned toner and developer techniques is being applied to a part of the field of printing associated with digitalization and colorization thereof, and is being pronouncedly practiced in the fields of graphic arts and short run printing including on-demand printing.

The term "filed of graphic arts" referred herein means fields of business relating to mass production of printed matters, which is referred to as reproduction and duplication, of creative printing with a small number of copies, such as engrave printing, and the original art works, such as calligraphy and painting, among the ordinary fields of business and sectors relating to production of printed matters.

In the field of short run printing, in addition to the monochrome printing, such a technology has been developed that targets short run color printing represented by Color Docu Tech 60 by Fuji Xerox Co., Ltd. by exploiting the characteristic features of the electrophotographic method, and major breakthroughs have occurred in image quality, dealing with transfer paper, product price, and cost per one printed sheet (as described in Journal of the Imaging Society of Japan, vol. 40, No. 2 (2001)).

In comparison to the conventional full-fledged printing, however, the electrophotographic image forming method is liable to involve problems, although the on-demand characteristics are exploited owing to printing using no printing plate, in the image quality including color reproduction range, resolution and glossiness, the texture, the uniformity within one image, the maintenance of image quality upon continuous printing for a long period of time, the high cost per one sheet due to the large toner consumption amount for high image density, the dealing with thinner or thicker paper, the image defect and poor writing capability due to an oil remaining after fixation of an image, and elongation, curling and wrinkle of transfer paper and deviation in registers upon double face printing due to image fixation at high temperature and high pressure. Furthermore, because a toner image formed of a low molecular weight resin having a relatively low melting point is fixed with heat as the principal of the method, there are some cases where the resulting image has poor resistance to heat and mechanical stress in comparison to the ordinarily printed image. Therefore, in the case where the image is exposed under high pressure and high temperature after folded several times over or bound as a book, there are some cases where problems occurs in durability against various kinds of stress, such as defects in image, blocking, offset, deteriorated light resistance upon outdoor exposure and deteriorated weather resistance.

As having been described, it has been found that there are many problems in the case where the electrophotographic image formation is utilized as a commercially valuable productive property in the field of graphic arts to substitute the ordinary full-fledged printing.

In order to improve the color reproduction range, colorants having higher performance are necessary since the pigments practically used in the field of electrophotography are poor in variation in comparison to those used in the conventional printing ink. There are a wide range of service conditions in the field of graphic arts as compared to the office market, and therefore images necessarily have various kinds of durability including heat resistance, light resistance, oil resistance, solvent resistance, scratch resistance folding resistance, in addition to high color reproducibility.

In the image processing system and the system including a photoreceptor and exposure thereof, the resolution of the image is liable to be influenced by the particle diameter of the toner and the particle diameter distribution thereof, and there are major technical problems in the case where a toner having a smaller diameter is used effectively with high reliability in respective process steps of charging, developing, transferring, fixing and cleaning.

For example, there are rooms to improve in such systems for dealing with the toner having a small diameter as design of a carrier, a charging blade or a charging roll for uniformly charging the toner having a small diameter, a developing system for obtaining a high density image without occurrence of background stain, a transferring system for realizing fine transferring with high efficiency, a fixing system for dealing with combinations of various kinds of paper with the toner having a small diameter, and a cleaning system for removing the toner having a smaller diameter completely from the photoreceptor or the intermediate transfer material to realize stable image quality.

In order to improve the in-plane uniformity and defects of an image, it is important to control the uniformity in developing capability of a developer in the developing system. In order to attain the commercial demand in maintenance of image quality, such a developer is necessary that maintains stable charging property and stable and uniform development during continuous printing exceeding several thousands of sheets, and that has high durability with less dependency to the environment including temperature and humidity, and the developing system with high durability is necessarily optimized for maintaining the uniform in-plane density by avoiding influences of paper powder and foreign matters and preventing defects and noises from occurring.

As the transferring system for transferring an image from the photoreceptor or the intermediate transfer material, an electrostatic transferring system is ordinarily used in the current electrophotographic system. In the case of a color image having a large thickness due to accumulation of toners of respective colors, it is necessary that the precise control of the behavior of the toner in an electric field is optimized in order to suppress deterioration of the image due to scattering of the toner upon transferring, and in some cases, such a transferring system is necessary that can drastically prevent scattering of the toner by using adhesion transferring without an electrostatic force.

It is also necessary that the cleaning system is optimized from the toner material, the structure and the hardware system in order to clean continuously the toner having a small diameter with a controlled shape, such as a spherical shape, with high reliability without environmental dependency by blade cleaning, electrostatic brush cleaning, magnetic brush cleaning, web cleaning and cleaning simultaneously with development, associated with a photoreceptor having high durability.

In response to the demand for decreasing the cost per one sheet, it is necessary to decrease the toner consumption amount by decreasing the toner diameter and optimizing the amount of the colorant, which are liable to influence on the uniformity in image quality. It is important for decreasing the cost per one sheet that the amount of disposal output for obtaining stable image quality, which largely influences on the cost upon printing, is decreased, and the maintenance load is decreased, by realizing the aforementioned highly reliable image formation system.

In order to deal with thinner or thicker paper, it is necessary that paper having poor stiffness, such as thin paper, or a plastic film can be easily released from the fixing member, such as a fixing roll, after fixing, and such a toner is used that is capable of being fixed at a low temperature to suppress the electric power consumption upon fixing coated paper or thicker paper. The stress on the transfer paper can be reduced by lowering the temperature and the pressure upon fixing, and thus elongation, curling and wrinkle of transfer paper and deviation in registers can be resolved. In order to avoid image defects, such as spots and stripes, and poor writing capability, due to an oil, it is necessary to use an oilless fixing device or an oilless toner containing a releasing agent inside the toner.

Furthermore, in order to attain image durability causing no problem under various use conditions as being equivalent to the ordinary printed image, it is necessary that the characteristics of the resin used in the conventional toner are largely improved.

In order to improve the degree of freedom and the uniformity of the glossiness characteristics, it is necessary that the fixing device is optimized associated with control of the viscoelasticity of the toner. In order to obtain high grade image quality equivalent to the offset printing, it is important that such glossiness is realized that is optimized to paper used to improve the market value, and thus, the combination of the toner, the paper and the fixing system is necessarily optimized.

In the filed of on-demand printing, the environmental load capability thereof is demanded to be improved in recent years. In the case where the printing is carried out by an on-demand operation, the stocks can be omitted or minimized to lower the environmental load associated with stocks, transportation and disposal of printed matters, which are liable to occur in the ordinary printing operation. The dry toner used in the ordinary electrophotography does not contain an organic solvent, which is used in an ink for the ordinary printing machine, whereby the environmental load associated with VOC can be drastically reduced. In order to attain further improvement, however, it is important that not only the electric energy used on fixing an image and on maintaining the hardware conditions is reduced, but also odors and volatile matters generated from the resin fused by heating upon fixing and substances with questions arising in carcinogenicity and environmental endocrine disruption are lowered or avoided, and the toner components having smaller diameters are prevented from being exhausted to the exterior of the machine. Furthermore, the recyclability of the waste toner and printing paper are also necessarily considered.

As having been described, in order to deal with the demands in the fields of graphic arts and short run printing, it is necessary that the conventional electrophotography techniques are further advanced as a total system.

In the image forming method by electrophotography, the image is generally fixed by heating to a temperature far exceeding 100° C., which is the boiling point of water. Under the aforementioned demands, such a phenomenon brings about a fatal problem in the field of graphic arts and short run printing that fixation unevenness and roughness in images caused by blister (roughness on image surface due to vaporization of moisture) occur due to vaporization of moisture from the transfer paper upon fixing, so as to provide unevenness in images and color fluctuation within the same page or among pages, which deteriorate the grade of the image.

SUMMARY OF THE INVENTION

The present invention has been made in view of the above circumstances and provide such a method for forming an image that causes less roughness in image, provides excellent fixing property, and is capable of stably forming a color image having a wide color reproduction range with high image quality and high grade.

According to a first aspect of the invention, a method for forming an image includes transferring a toner having a volume average particle diameter of 5 μm or less to a recording medium as a toner image having a monochromatic maximum toner mass per area of 3.5 g/m$^2$ or less and fixing the toner image at a surface temperature of a fixing roll which is equal to or less than 130° C.

According to a second aspect of the invention, an image forming apparatus includes a transfer unit which transfers a toner having a volume average particle diameter of 5 μm or less to a recording medium as a toner image having a monochromatic maximum toner mass per area of 3.5 g/m$^2$ or less and a fixing roll which fixes the toner image at a surface of the fixing roll. Temperature of the surface of the fixing roll is equal to or less than 130° C.

DETAILED DESCRIPTION OF THE PREFERRED EMBODIMENTS

Hereinafter, an image forming method according to the present invention will be described in detail.

The present invention found that an image is formed by using a toner having a small diameter to a reduced toner mass per area and is fixed at a relatively low temperature, whereby a color image excellent in fixing property with high quality and high grade without roughness can be formed, and thus the invention has been completed.

Figure 1A:
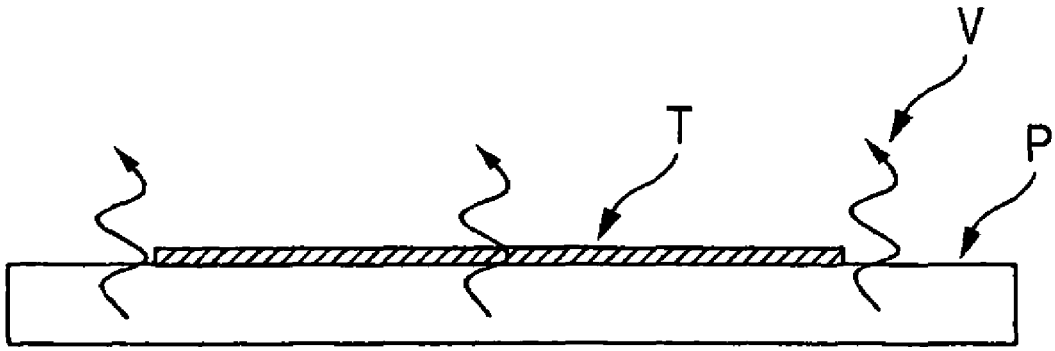
FIG. 1A is a conceptual illustration of a toner image on transfer paper immediately after transfer under fixing conditions of the method for forming an image according to the invention.
Figure 1B:
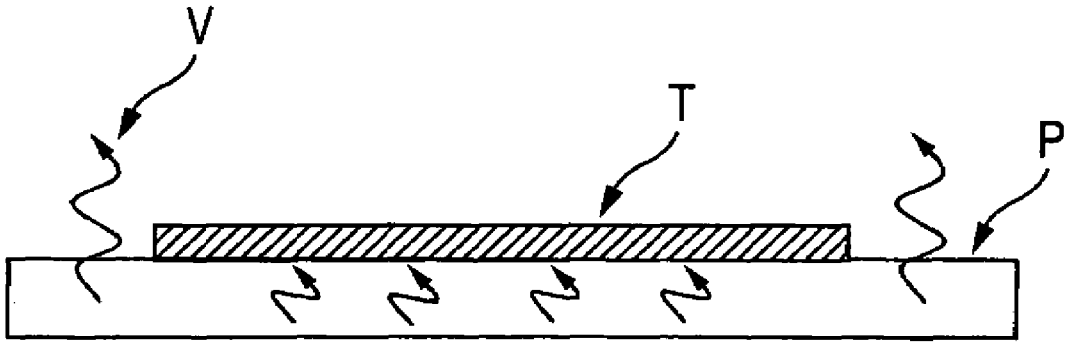
FIG. 1B is a conceptual illustration of a toner image on transfer paper immediately after transfer under ordinary fixing conditions.

In the fixing conditions of the ordinary image formation, it is considered that moisture is vaporized from a transfer medium P containing moisture immediately after fixing, and the vaporized moisture V is held between the transfer medium P and a toner image T to cause roughness in image, as shown in FIG. 1B. In the image formation process of the invention, on the other hand, it is considered that the amount of vaporized moisture is small owing to the relatively low fixing temperature, and in addition, the vaporized moisture V is transmitted through the toner image T owing to the small toner mass per area, so as to prevent roughness in image from occurring, as shown in FIG. 1A.

The invention relates to a method for forming an image containing steps of: transferring a toner having a volume average particle diameter of 5 μm or less to transfer paper as a toner image having a monochromatic maximum toner mass per area of 0.35 mg/cm$^2$ or less; and fixing the toner image at a surface temperature of a fixing roll of 130° C. or less.

In the method for forming an image according to the invention, the volume average particle diameter of the toner is preferably 4.8 μm or less, and more preferably 4.5 μm or less. By using a toner having a smaller diameter than the conventional techniques, formation of color unevenness and defects derived from unevenness in fixing the image are suppressed to, provide an image with high grade in the case where an image with a low toner mass per area (low TMA). Furthermore, it is further effective that the shape of the toner having a small diameter is made more spherical, and the amount of the colorant component contained in the toner is increase in comparison to the conventional product. Moreover, uniform an wide reproduction range can be obtained with less occurrence of image defects, such as scattering of line parts in the image and dropouts in the character image, by narrowing the particle size distribution of the toner.

In the method for forming an image according to the invention, the monochromatic maximum toner mass per area is −0.35 mg/cm$^2$ or less. Moisture vaporized from the fixing medium, such as paper, upon fixing largely influences the formation of a fixed image. In particular, the fixation is carried out at a high temperature, where moisture is instantaneously vaporized, under the condition where the saturated moisture amount of paper is large, such as the rainy season, the surface of the fixed image or the paper is severely roughened by vaporization of moisture upon fixing. The problem becomes conspicuous in the case where the covering thickness of the toner, i.e., the toner mass per area, of the toner image on the fixing medium is increased. The monochromatic maximum toner mass per area in the invention is preferably −0.3 mg/cm$^2$ or less from the standpoint of realization of high image quality.

In the method for forming an image according to the invention, the surface temperature of a fixing roll is 130° C. or less. Vaporization of moisture is suppressed at a lower temperature, and thus, the surface temperature of the fixing roll is preferably 120° C. or less. A method for forming an image excellent in energy saving can be provided by using fixation at a lower temperature.

The toner having a small diameter used in the invention is preferably a crystalline toner. The gradient of an elasticity per temperature of the crystalline toner after melting is preferably small since the influence of temperature fluctuation upon fixing is reduced to attain uniformity in fixed images.

Specifically, the gradient of a storage elasticity per temperature in a temperature range of from Tm+20° C. to Tm+50° C., where Tm represents a melting temperature of a crystalline resin contained in the crystalline toner, is preferably 0.02 log (Pa)/° C. or less, and more preferably 0.017 log (Pa)/° C. Here, Pa represents pressure and is in unit of N/m$^2$. In the case where the toner mass per area per unit area is decreased, there has been such a possibility that unevenness in toner mass per area, unevenness in image and unevenness in color difference are more conspicuous. In comparison to the conventional techniques, however, even in the case where an image with a low toner mass per area is formed, the temperature dependency of the storage elasticity after melting the crystalline toner is reduced to the certain value or less, whereby the influence of unevenness in temperature upon fixing can be reduced to suppress unevenness in color and defects caused by unevenness in fixation of the image. Furthermore, the use of a crystalline toner having a small gradient of a storage elasticity per temperature after melting provides a high color transferring efficiency giving a color image having higher quality with excellent wear resistance and durability maintained.

In another embodiment of the invention, the fixing time in the fixing step is from 50 to 500 ms. Owing to the fixation at a relatively low temperature, the fixing time is preferably longer than the conventional techniques for reducing the influence of unevenness in temperature upon fixing and suppressing unevenness in color and defects caused by unevenness in fixation of the image. The fixing time is generally about from 20 to 40 ms in the conventional techniques, but in the invention, it is preferably from 50 to 500 ms.

The fixing time referred herein means a period of time from the time when a part to be fixed enters a curl nip part to the time when it leave therefrom. The fixing time can be controlled by adjusting the fixing speed. Specifically, the fixing time can be shortened by increasing the paper conveying speed. The fixing time can also be prolonged by using an elastic roll or the like to enhance the nip width.

In still another embodiment of the invention, the toner having a small diameter has a shape factor SF1 of 125 or less. The shape factor SF1 is defined by $$SF1=(ML^2/A)\times(\pi/4)\times 100$$

where ML represents a peripheral length of the toner, and A represents a projected area of the toner. The shape factor SF1 of the toner is preferably 125 or less for suppressing occurrence of unevenness in color and defects to provide a uniform image with good developing and transferring properties even in the case where the thickness of the toner image in the developing and fixing stages is smaller than the conventional techniques.

In a further embodiment of the invention, the toner has a volume average particle size distribution index GSDv of 1.20 or less. In order to prevent scattering of the toner and dropouts of the image upon developing and transferring, the volume average particle size distribution index GSDv of the toner is preferably 1.20 or less.

In a still further embodiment of the invention, the toner contains a colorant in an amount of 8% by weight (mass) or more on the total solid content of the toner. In order to attain sufficient coloring power with a lower toner mass per area than the conventional techniques, the content of the colorant in the toner is preferably 8% by weight or more, and more preferably 9% by weight or more on the total solid content of the toner.

In a still further embodiment of the invention, the toner has a surface property index expressed by the following equation of 2.0 or less.

$$\text{(surface property index)}=\text{(measured specific surface area)}/\text{(calculated specific surface area)}$$

$$\text{(calculated specific surface area)}=6\Sigma(n\times R^2)/(\rho\times\Sigma(n\times R^3))$$

where n represents the number of particles in a channel of a particle size distribution measurement device; R represents a diameter of the channel of the particle size distribution measurement device; and ρ represents a density of the toner, where the division number of the channel is 16.

The toner used in the method for forming an image according to the invention has a surface property index defined by the equation adjusted to 2.0 or less, whereby good transferring property is exerted, and high image quality is realized with high transferring efficiency with high uniformity particularly upon transferring to paper or a transfer medium having a large surface roughness.

The toner used in the method for forming an image according to the invention can be obtained by mixing at least one kind of a resin particle dispersion liquid and at least one kind of colorant dispersion liquid, adding an aggregating agent thereto to form aggregated particles, and fusing the aggregated particles by heating to a temperature higher than the glass transition point of the resin particles to form toner particles.

Examples of the colorant contained in the toner used in the method for forming an image according to the invention include the following colorants.

Examples of a black pigment include carbon black, copper oxide, manganese dioxide, aniline black, activated carbon, non-magnetic ferrite and magnetite.

Examples of a yellow pigment include zinc yellow, yellow iron oxide, cadmium yellow, chrome yellow, Hansa Yellow, Hansa Yellow 10G, Benzidine Yellow G, Benzidine Yellow GR, Threne Yellow, Quinoline Yellow and Permanent Yellow NCG.

Examples of an orange pigment include red chrome yellow, Molybdenum Orange, Permanent Orange GTR, Pyrazolone Orange, Vulcan Orange, Benzidine Orange G, Indanthrene Brilliant Orange RK and Indanthrene Brilliant Orange GK.

Examples of a red pigment include red iron oxide, Cadmium Red, red lead oxide, mercury sulfide, Watchyoung Red, Permanent Red 4R, Lithol Red, Brilliant Carmine 3B, Brilliant Carmine 6B, Du Pont Oil Red, Pyrazolone Red, Rhodamine B Lake, Lake Red C, Rose Bengal, Eosin Red, Alizarin Lake and Naphthol Red, such as Pigment Red 146, 147, 184, 185, 155, 238 and 269.

Examples of a blue pigment include Iron Blue, Cobalt Blue, Alkali Blue Lake, Victoria Blue Lake, Fast Sky Blue, Indanthrene Blue BC, Aniline Blue, Ultramarine Blue, Calco Oil Blue, Methylene Blue Chloride, Phthalocyanine Blue, Phthalocyanine Green and Malachite Green Oxalate.

Examples of a violet pigment include Manganese Violet, Fast Violet B and Methyl Violet Lake.

Examples of a green pigment include chromium oxide, Chromium Green, Pigment Green, Malachite Green Lake and Final Yellow Green G.

Examples of a white pigment include Zinc White, titanium oxide, Antimony White and zinc sulfate.

Examples of a body pigment include barite powder, barium carbonate, clay, silica, white carbon, talc and alumina white.

Examples of a dye include various basic, acidic, dispersion and direct dyes, for example, nigrosine, Methylene Blue, Rose Bengal, Quinoline Yellow and Ultramarine Blue.

The colorant may be used solely or as a mixture thereof. The dispersion liquid of the colorant can be produced by using a dispersing machine, such as a rotation shearing homogenizer, a media dispersing machine, such as a ball mill, a sand mill and an Attritor, and a high-pressure counter collision dispersing machine. The colorant may be dispersed in an aqueous system with a homogenizer by using a polar surfactant.

The colorant of the toner used in the method for forming an image according to the invention is appropriately selected from the standpoint of hue angle, chroma saturation, brightness, weather resistance, OHP transparency and dispersibility in the toner.

The colorant is added in an amount of from 4 to 20% by weight based on the total solid mass constituting the toner.

In the case where a magnetic material is used as a black colorant, the colorant may be added in an amount of from 12 to 240% by weight, as being different from the other colorants.

The aforementioned range of the addition amount of the colorant is such an amount that is necessary for ensuring coloration upon fixing. In the case where the colorant particles in the toner have a center diameter (median diameter) of from 100 to 330 nm, the OHP transparency and the coloration can be ensured.

The center diameter of the colorant particles herein is measured, for example, with a laser diffraction particle size measuring apparatus (LA-700, produced by Horiba, Ltd.).

In the case where the toner is used as a magnetic toner, magnetic powder may be added thereto. Specifically, a substance that is magnetized in a magnetic field is used, and specific examples thereof include ferromagnetic powder, such as iron, cobalt and nickel, and a ferromagnetic compound, such as ferrite and magnetite.

In the case where the toner used in the method for forming an image according to the invention is obtained in an aqueous phase, the aqueous phase transition property of the magnetic material is necessarily noted, and it is preferred that the surface of the magnetic material is previously modified, for example, is subjected to a hydrophobic treatment.

The gradient of a storage elasticity per temperature after melting of the toner is important for reducing the influence of temperature fluctuation upon fixing to realize uniformity of fixed images. As a toner exhibiting such a melting behavior, it is effective to use a crystalline toner using a crystalline resin as a binder resin. Examples of the crystalline resin will be described below.

A crystalline polyester resin is preferred as the crystalline resin, and a crystalline aliphatic polyester resin having a suitable melting point is more preferred. The crystalline polyester resin will be described below.

The crystalline aliphatic polyester resin includes those obtained by progress of ring-opening polymerization, such as polycaprolactone, but many examples thereof are those synthesized from an acid component (a dicarboxylic acid) and an alcohol (a diol). In the invention, the term "acid derived constitutional component" means such a constitutional component of a polyester resin that is derived from the acid component, and the term "alcohol derived constitutional component" means such a constitutional component of a polyester resin that is derived from the alcohol component.

In the case where the polyester resin is not crystalline, i.e., is amorphous, it is difficult that the toner blocking resistance and the image storage stability cannot be maintained with the favorable low temperature fixing property maintained. Therefore, the crystalline polyester resin in the invention means such a polyester resin that exhibits a clear endothermic peak upon measuring with a differential scanning calorimeter (DSC) rather than stepwise change in endothermic amount. In the case of a polymer obtained by copolymerizing the crystalline polyester as a main chain with other components, the copolymer is designated as the crystalline polyester resin when the amount of the other components is 50% by weight or less.

[Acid Derived Constitutional Component]

As the acid derived constitutional component, a constitutional component derived from an aliphatic dicarboxylic acid is preferred, and that derived from a linear aliphatic dicarboxylic acid is particularly preferred. Examples of the linear aliphatic dicarboxylic acid include oxalic acid, malonic acid, succinic acid, glutaric acid, adipic acid, pimelic acid, suberic acid, azelic acid, seba cic acid, 1,9-nonanedicarboxylic acid, 1,10-decanedicarboxylic acid, 1,11-undecanedicarboxylic acid, 1,12-dodecanedicarboxylic acid, 1,13-tridecanedicarboxylic acid, 1,14-tetradecanedicarboxylic acid, 1,16-hexadecanedicarboxylic acid, 1,18-octadecanedicarboxylic acid and a lower alkyl ester and an anhydride thereof, but the acid derived constitutional component is not limited to these examples.

As the acid derived constitutional component, a dicarboxylic acid derived constitutional component having a double bond and a dicarboxylic acid derived constitutional component having a sulfonic acid group are preferably contained in addition to the aforementioned aliphatic dicarboxylic acid derived constitutional component.

The dicarboxylic acid derived constitutional component having a double bond includes a constitutional component derived from a lower alkyl ester or an anhydride of a dicarboxylic acid having a double bond in addition to a constitutional component derived from a dicarboxylic acid having a double bond. The dicarboxylic acid derived constitutional component having a sulfonic acid group includes a constitutional component derived from a lower alkyl ester or an anhydride of a dicarboxylic acid having a sulfonic acid group in addition to a constitutional component derived from a dicarboxylic acid having a sulfonic acid group.

The dicarboxylic acid having a double bond is preferably used for preventing hot offset upon fixing since the entire resin can be crosslinked by utilizing the double bond thereof. Examples of the dicarboxylic acid include fumaric acid, maleic acid, 3-hexenedioic acid and 3-octendioic acid, but the dicarboxylic acid is not limited to these examples. Examples thereof also include lower alkyl esters and anhydrides thereof. Among these, fumaric acid and maleic acid are preferred from the standpoint of cost.

The dicarboxylic acid having a sulfonic acid group is preferred since the colorant, such as a pigment, can be favorably dispersed.

In the case where the entire resin is emulsified or suspended in water to produce toner mother particles as particles, the presence of the sulfonic acid group enables emulsification or suspension with no surfactant, as described later. Examples of the dicarboxylic acid having a sulfonic acid group include sodium 2-sulfoterephthalate, sodium 5-sulfoisophthalate and sodium sulfosuccinate, but the dicarboxylic acid having a sulfonic acid group is not limited to these examples. Examples thereof also include lower alkyl esters and anhydrides thereof. Among these, sodium 5-sulfoisophthalate is preferred from the standpoint of cost.

The content of the acid derived constitutional component other than the aliphatic dicarboxylic acid derived constitutional component (i.e., the dicarboxylic acid derived constitutional component having a double bond and/or the dicarboxylic acid derived constitutional component having a sulfonic acid group) in the total acid derived constitutional component is preferably from 1 to 20% by molar composition, and more preferably from 2 to 10% by molar composition.

In the case where the content is less than 1% by molar composition, there are some cases where the pigment cannot be favorably dispersed, or the particle diameter of the emulsified particles is increased, whereby adjustment of the toner diameter by aggregation becomes difficult. In the case where the content exceeds 20% by molar composition, on the other hand, there are some cases where the crystallinity of the polyester resin is decreased to lower the melting point, whereby the storage stability of the image is deteriorated, and the polyester is dissolved in water due to the too small emulsion particle diameter to fail to form latex. The unit "% by molar composition" referred herein means a percentage with the constitutional components (i.e., the acid derived constitutional components and the alcohol derived constitutional components) each being designated as one unit (molecule).

[Alcohol Derived Constitutional Component]

As the alcohol derived constitutional component, a constitutional component derived from an aliphatic diol, examples of which include ethylene glycol, 1,3-propanediol, 1,4-butanediol, 1,5-pentanediol, 1,6-hexanediol, 1,7-heptanediol, 1,8-octanediol, 1,9-nonanediol, 1,10-decanediol, 1,11-dodecanediol, 1,12-undecanediol, 1,13-tridecanediol, 1,14-tetradecanediol, 1,18-octadecanediol and 1,20-eicosanediol, but the aliphatic diol is not limited to these examples.

In the case where the alcohol derived constitutional component is an aliphatic diol derived constitutional component, the content of the aliphatic diol derived constitutional component is 80% by molar composition or more, and other components may be contained depending on necessity. Furthermore, in the case where the alcohol derived constitutional component is an aliphatic diol derived constitutional component, the content of the aliphatic diol derived constitutional component is preferably 90% by molar composition or more.

In the case where the content of the aliphatic diol derived constitutional component is less than 80% by molar composition, the crystallinity of the polyester resin is decreased to lower the melting point, and the toner blocking resistance, the image storage stability and the low temperature fixing property are deteriorated.

Examples of the other components contained depending on necessity include such a constitutional component as a diol derived constitutional component having a double bond and a diol derived constitutional component having a sulfonic acid group.

Examples of the diol having a double bond include 2-butene-1,4-diol, 3-butene-1,6-diol and 4-butene-1,8-diol.

Examples of the diol having a sulfonic acid group include 1,4-dihydroxy-2-sulfobenzene sodium salt, 1,3-dihydroxymethyl-5-sulfobenzene sodium salt and 2-sulfo-1,4-butanediol sodium salt.

In the case where an alcohol derived constitutional component other than the linear aliphatic diol derived constitutional component is added, i.e., the diol derived constitutional component having a double bond and/or the diol derived constitutional component having a sulfonic acid group is added, the content of the diol derived constitutional component having a double bond and/or the diol derived constitutional component having a sulfonic acid group in the total alcohol derived constitutional component is preferably from 1 to 20% by molar composition, and more preferably from 2 to 10% by molar composition.

In the case where the content of the alcohol derived constitutional component other than the linear aliphatic diol derived constitutional component in the total alcohol derived constitutional component is less than 1% by molar composition, there are some cases where the pigment cannot be favorably dispersed, or the particle diameter of the emulsified particles is increased, whereby adjustment of the toner diameter by aggregation becomes difficult. In the case where the content exceeds 20% by molar composition, on the other hand, there are some cases where the crystallinity of the polyester resin is decreased to lower the melting point, whereby the storage stability of the image is deteriorated, and the polyester is dissolved in water due to the too small emulsion particle diameter to fail to form latex.

The melting point of the binder resin of the crystalline toner used in the method for forming an image according to the invention is preferably from 50 to 120° C., and more preferably from 60 to 110° C. In the case where the melting point is lower than 50° C., problems arise in the storage stability of the toner and the storage stability of the toner image after fixing. In the case where the melting point exceeds 120° C., sufficient low temperature fixing property cannot be obtained in comparison to the conventional toners. Furthermore, the melting point of the binder resin of the crystalline toner is preferably lower than the fixing temperature of the method for forming an image, to which the toner is applied, by from 5 to 15° C.

The melting point of the crystalline resin can be measured in such a manner that an input compensation differential calorimetric measurement defined in JIS K7121 is carried out by using a differential scanning calorimeter (DSC) from room temperature to 150° C. with a temperature increasing rate of 10° C. per minute, and the melting point is obtained as a melt peal in the measurement. In the case where the crystalline resin has plural melt peaks, the maximum peak is designated as the melting point in the invention.

The polyester resin is not particularly limited in production process thereof and can be produced by an ordinary polyester polymerization process, in which an acid component and an alcohol component are reacted with each other. For example, the direct polycondensation process and the ester exchange process may be selected depending on the species of the monomers. The molar ratio of the acid component and the alcohol component upon reaction cannot be determined unconditionally since it varies depending on the reaction conditions and the like, and is generally about 1/1.

The production of the polyester resin can be carried out at a polymerization temperature of from 180 to 230° C., and the reaction is effected while the system is depressurized depending on necessity for removing water and an alcohol generated upon condensation.

In the case where the monomers are not dissolved in each other at the reaction temperature, a high boiling point solvent may be added as a dissolution assistant. The polycondensation reaction is carried out while the dissolution assistant is distilled out. In the case where a monomer having poor solubility is present in the copolymerization reaction, it is preferred that the monomer having poor solubility is previously condensed with an acid or an alcohol to be polycondensed with the monomer, and then subjected to the polycondensation.

Examples of a catalyst that can be used in production of the polyester resin include an alkali metal compound, such as compounds of sodium and lithium, an alkaline earth metal compound, such as compounds of magnesium and calcium, a metallic compound, such as compounds of zinc, manganese, antimony, titanium, tin, zirconium and germanium, a phosphorous acid compound, a phosphoric acid compound and an amine compound, and specific examples thereof include sodium acetate, sodium carbonate, lithium acetate, lithium carbonate, calcium acetate, calcium stearate, magnesium acetate, zinc acetate, zinc stearate, zinc naphthenoate, zinc chloride, manganese acetate, manganese naphthenoate, titanium tetraethoxide, titanium tetrapropoxide, titanium tetraisopropoxide, titanium tetrabutoxide, antimony trioxide, triphenylantimony, tributylantimony, tin formate, tin oxalate, tetraphenyltin, dibutyltin dichloride, dibutyltin oxide, diphenyltin oxide, zirconium tetrabutoxide, zirconium naphthenoate, zirconyl carbonate, zirconyl acetate, zirconyl stearate, zirconyl octylate, germanium oxide, triphenylphosphite, tris(2,4-di-t-butylphenyl)phosphite, ethyltriphenylphosphonium bromide, triethylamine and triphenylamine.

In the case where emulsification aggregation method is employed, the process for producing the toner for developing an electrostatic image used in the method for forming an image according to the invention preferably contains an aggregating step of forming aggregated particles containing a crystalline polyester resin in a dispersion liquid containing at least the crystalline polyester resin, and an adhering step of adhering amorphous polymer particles to the surface of the aggregated particles, and more preferably further contains a fusing step of fusing the aggregated particles by heating.

[Emulsifying Step]

In an emulsifying step, the raw material dispersion liquid is formed by applying a shearing force to a solution obtained by mixing emulsified particles of the binder resin (hereinafter, referred to as "resin particles") and a dispersion liquid containing a colorant and a releasing agent depending on necessity in an aqueous medium. Therefore, it is necessary that the binder resin is previously dispersed as resin particles in the raw material dispersion liquid.

The resin particles generally have an average particle diameter of 1 μm or less, and preferably from 0.01 to 1 μm. In the case where the average particle diameter exceeds 1 μm, there are cases where the particle diameter distribution of the toner for developing an electrostatic image finally obtained is broadened, and free particles are formed, so as to bring about deterioration in performance and reliability. In the case where the average particle diameter is in the range, on the other hand, the aforementioned problems do not occur, and maldistribution among the toner particles is reduced to improve dispersion thereof in the toner, whereby fluctuation in performance and reliability is advantageously reduced. The average particle diameter can be measured, for example, by using a particle size distribution measurement device such as a Coulter Counter.

Examples of the dispersing medium include an aqueous medium and an organic solvent.

Examples of the aqueous medium include water, such as distilled water and ion exchanged water, and an alcohol. These may be used solely or in combination of two or more kinds thereof. In the invention, a surfactant is preferably added to and mixed with the aqueous medium. The surfactant is not particularly limited, and examples thereof include an anionic surfactant, such as a sulfate salt compound, a sulfonate salt compound, a phosphate ester compound and a soap compound, a cationic surfactant, such as an amine salt compound and a quaternary ammonium salt compound, and a nonionic surfactant, such as a polyethyleneglycol, an alkylphenol ethylene oxide adduct and a polyhydric alcohol. Among these, the anionic surfactant and the cationic surfactant are pre erred. The nonionic surfactant is preferably used in comb nation of the anionic surfactant or the cationic surfactant. The surfactant may be used solely or in combination of two or more kinds thereof.

Specific examples of the anionic surfactant include sodium dodecylbenzenesulfonate, sodium dodecylsulfate, sodium alkylnaphthalenesulfonate and sodium dialkylsulfosuccinate. Specific examples of the cationic surfactant include alkylbenzene dimethylammonium chloride, alkyltrimethylammonium chloride and distearylammonium chloride. Among these, an ionic surfactant, such as an anionic surfactant and a cationic surfactant, is preferred.

Examples of the organic solvent include ethyl acetate and toluene, which may be appropriately selected depending on the binder resin.

Examples of the binder resins include homopolymers and copolymers of styrenes such as styrene and p-chlorostyrene; vinyl esters such as vinylnaphthalene, vinyl chloride, vinyl bromide, vinyl fluoride, vinyl acetate, vinyl propionate, vinyl benzoate, and vinyl butyrate; methylene aliphatic carboxylic acid esters such as methyl acrylate, ethyl acrylate, n-butyl acrylate, isobutyl acrylate, dodecyl acrylate, n-octyl acrylate, 2-chloroethyl acrylate, phenyl acrylate, α-chloromethyl acrylate, methyl methacrylate, ethyl methacrylate, and butyl methacrylate; acrylonitrile; methacrylonitrile; acrylamide, vinyl ethers such as vinylmethylether, vinylethylether, and vinylisobutylether; monomers having an N-containing polar group such as N-vinyl compounds including N-vinylpyrrole, N-vinylcarbazole, N-vinylindole, and N-vinylpyrrolidone; vinyl monomers such as vinylcarboxylic acids including methacrylic acid, acrylic acid, cinnamic acid, and carboxyethyl acrylate. The examples thereof also include various polyesters and various waxes.

If a vinyl monomer is used, the resin dispersion can be prepared in an emulsion polymerization by using an ionic surfactant or the like. Alternatively, if an other resin is used and is soluble in an oily, water-insoluble solvent, the resin dispersion can be prepared by dissolving the resin in a suitable solvent; dispersing the solution in water in the form of particles together with an ionic surfactant and an polymer electrolyte by using a dispersing machine such as a homogenizer; and then removing the solvent under heat or under reduced pressure.

The average diameter (median diameter) of the resin particles in the resin dispersion thus obtained is 1 μm or less, preferably 50 to 400 nm, and more preferably in the range of 70 to 350 nm. The average diameter of the resin particles is determined, for example, by a laser-diffraction particle size distribution-measuring device (LA-700, manufactured by Horiba, Ltd.).

In the case where the resin particles are formed with a homopolymer or a copolymer of a vinyl monomer, such as an ester compound having a vinyl group, a vinylnitrile compound, a vinyl ether compound and a vinyl ketone compound (i.e., a vinyl resin), the vinyl monomer is subjected to emulsion polymerization of seed polymerization in an ionic surfactant to prepare a dispersion liquid having resin particles formed with a homopolymer or a copolymer of the vinyl monomer (i.e., a vinyl resin) dispersed in the ionic surfactant.

In the case where the resin particles are formed with other resin than the homopolymer or copolymer of the vinyl monomer, and the resin can be dissolved in an oily solvent having relatively low solubility in water, the resin is dissolved in the oily solvent to form a solution, which is the dispersed to particles in water along with an ionic surfactant and a polymer electrolyte by using a dispersing machine, such as a homogenizer, and then the oily solvent is evaporated by heating or depressurizing to prepare a dispersion liquid having resin particles formed with the resin other than the vinyl resin dispersed in the ionic surfactant.

In the case where the resin particles are formed with a crystalline polyester resin or an amorphous polyester resin, the resin has self-water dispersibility owing to a functional group capable of becoming an anionic form through neutralization, and thus a stable aqueous dispersion under action of an aqueous medium through neutralization of the entire or a part of the functional groups capable of becoming a hydrophilic group with a base. The functional group capable of becoming a hydrophilic group in the crystalline polyester resin or the amorphous polyester resin is an acidic group, such as a carboxyl group and a sulfonic group, and therefore, examples of the neutralizing agent include an inorganic base, such as sodium hydroxide, potassium hydroxide, lithium hydroxide, calcium hydroxide, sodium carbonate and ammonia, and an organic base, such as diethylamine, triethylamine and isopropylamine.

In the case where a polyester resin that is not dispersed in water by itself, i.e., has no self-water dispersibility, is used as the binder resin, the resin is dispersed in a resin solution and/or an aqueous medium to be mixed therewith along with an ionic surfactant and a polymer electrolyte, such as a polymer acid and a polymer base, and after heating to a temperature higher than the melting point, a strong shearing force is applied by a homogenizer or a pressure discharge dispersing device to obtain particles having a diameter of 1 μm or less easily. In the case where the ionic surfactant or the polymer electrolyte is used, the concentration thereof in the aqueous medium is suitably about from 0.5 to 5% by weight.

In order to modify the aforementioned resins, conventional resins may also be used simultaneously, and examples of such binder resins include a homopolymer and a copolymer of a vinyl monomer, for example, a vinyl ester compound, such as vinylnaphthalene, vinyl chloride, vinyl bromide, vinyl fluoride, vinylacetate, vinyl propionate, vinyl benzoate and vinyl butyrate, a methylene aliphatic carboxylate ester compound, such as methyl acrylate, ethyl acrylate, n-butyl acrylate, isobutyl acrylate, dodecyl acrylate, n-octyl acrylate, 2-chloroethyl acrylate, phenyl acrylate, methyl α-chloroacrylate, methyl methacrylate, ethyl methacrylate and butyl methacrylate, acrylonitrile, methacrylonitrile, acrylamide, a vinyl ether compound, such as vinyl methyl ether, vinyl ethyl ether and vinyl isobutyl ether, a monomer having a nitrogen-containing polar group, such as an N-vinyl compound, e.g., n-vinylpyrrol, n-vinylcarbazole, N-vinylindole and N-vinylpyrrolidone, and a vinyl carboxylic acid, such as methacrylic acid, acrylic acid, cinnamic acid and carboxyethyl acrylate, various kinds of polyester, and various kinds of wax.

The vinyl monomer can be formed into a resin particle dispersion liquid through emulsion polymerization using an ionic surfactant, and the other resin that is dissolved in an oily solvent having relatively low solubility in water can be formed into a resin particle dispersion liquid in such a manner that the resin is dissolved in the oily solvent and dispersed in a particle form in water with a dispersing machine, such as a homogenizer, along with an ionic surfactant or a polymer electrolyte, and the solvent is evaporated by heating or depressurizing.

The particles in the resin particle dispersion liquid of the invention thus obtained generally have a center diameter (median diameter) of 1 μm or less, preferably from 50 to 400 nm, and more preferably from 70 to 350 nm.

The center diameter of the resin particles herein is measured, for example, with a laser diffraction particle size measuring apparatus (LA-700, produced by Horiba, Ltd.).

A magnetic material, such as a metal, an alloy and a compound containing a metal, e.g., ferrite, magnetite, reduced iron, cobalt, nickel and manganese, may be used as an internal additive, and various kinds of charge controlling agents that have been ordinarily employed, such as a quaternary ammonium salt compound, a nigrosine compound, a dye containing a complex of aluminum, iron or chromium, and a triphenylmethane pigment, may be used. It is preferred that these materials are difficultly dissolved in water from the standpoint of control of the ion strength, which influences the stability upon aggregation and integration, and reduction in contamination of waste water.

Specific examples of the releasing agent used in the invention include a low molecular weight polyolefin compound, such as polyethylene, polypropylene and polybutene, a silicone compound exhibiting a softening point upon heating, an aliphatic amide compound, such as oleic acid amide, erucic acid amide, recinoleic acid amide and stearic acid amide, vegetable wax, such as carnauba wax, rice wax, candelilla wax, haze wax and jojoba oil, animal wax, such as bees wax, mineral or petroleum wax, such as montan wax, ozokerite, ceresin, paraffin wax, microcrystalline wax and Fischer-Tropsch wax, and modified products thereof.

The wax is substantially not dissolved in a solvent, such as toluene, at a temperature around room temperature, or may be dissolved an extremely slight amount even when it is dissolved.

The wax is dispersed in water along with an ionic surfactant or a polymer electrolyte, such as a polymer acid and a polymer base, and after heating to a temperature higher than the melting point thereof, dispersed into a particle form with a homogenizer or a pressure discharge dispersing machine (Gorin Homogenizer, produced by Gorin, Inc.) capable of applying a strong shearing force, so as to produce a dispersion liquid of particles having a diameter of 1 μm or less.

The releasing agent is preferably added in an amount of from 5 to 25% by weight based on the total mass of the solid content constituting the toner in order to ensure the releasing property of the fixed image in an oilless fixing system.

The diameter of the releasing agent particle dispersion liquid is measured, for example, with a laser diffraction particle size measuring apparatus (LA-700, produced by Horiba, Ltd.). Upon using the releasing agent, it is preferred for ensuring the durability that after aggregating the resin particles, the colorant particles and the releasing agent particles, another resin particle dispersion liquid is added to attach resin particles on the surface of the aggregated particles.

In order to improve weather resistance of the resulting image, a polymerizable ultraviolet ray stable monomer may be contained.

Examples of the ultraviolet ray stable monomer include 4-(meth)acryloyloxy-2,2,6,6-tetramethylpiperidine, 4-(meth)acryloylamino-2,2,6,6-tetramethylpiperidine, 4-(meth)acryloyloxy-1,2,2,6,6-pentamethylpiperidine, 4-(meth)acryloylamino-1,2,2,6,6-pentamethylpiperidine, 4-cyano-4-(meth)acryloylamino-2,2,6,6-tetramethylpiperidine, and 1-(meth)acryloyl-4-(meth)acryloylamino-2,2,6,6-tetra methylpiperidine.

These compounds may be used solely or in combination of two or more kinds thereof.

Examples of the surfactant used in the emulsion polymerization, the seed polymerization, dispersion of the pigment, dispersion of the resin particles, dispersion of the releasing agent, and stabilization thereof include an anionic surfactant, such as a sulfate ester compound, a sulfonate ester compound, a phosphate ester compound and a soap compound, a cationic surfactant, such as an amine salt compound and a quaternary ammonium salt compound, and a nonionic surfactant, such as a polyethylene glycol compound, an alkylphenol ethylene oxide compound and a polyhydric alcohol compound, which are effectively used in combination. Examples of the machine for dispersion include ordinary machines, such as a rotation shearing homogenizer and a media mill, such as a ball mill and a Dinor mill.

In organic particles, such as silica, alumina, titania and calcium carbonate, and resin particles, such as a vinyl resin, polyester and silicone, may be added to the toner used in the method for forming an image according to the invention after drying under application of a shearing force, in order to impart flowability and to improve the cleaning property, as similar to the ordinary toners.

In the case where the particles are attached to the toner in water, the inorganic particles, such as silica, alumina, titania, calcium carbonate, magnesium carbonate and tricalcium phosphate, which are ordinarily used as an external additive for the toner surface, may be used after dispersing with an ionic surfactant or a polymer electrolyte, such as a polymer acid and a polymer base.

The surfactant may be used for emulsion polymerization of the resin, dispersion of the pigment, dispersion of the resin particles, dispersion of the releasing agent, aggregation, and stabilization of the aggregated particles. Specific examples thereof include an anionic surfactant, such as a sulfate ester compound, a sulfonate ester compound, a phosphate ester compound and a soap compound, a cationic surfactant, such as an amine salt compound and a quaternary ammonium salt compound, and a nonionic surfactant, such as a polyethylene glycol compound, an alkylphenol ethylene oxide compound and a polyhydric alcohol compound, which are effectively used in combination. Examples of the machine for dispersion include ordinary machines, such as a rotation shearing homogenizer and a media mill, such as a ball mill, a sand mill and a Dinor mill.

After completing the fusing and integrating step of the aggregated particles, the target toner particles can be obtained through a washing step, a solid-liquid separating step and a drying step, which may be optionally effected, and the washing step is preferably carried out by washing with ion exchanged water by replacement washing under consideration of the charging property. The solid-liquid separating step is not particularly limited, suction filtration and pressurized filtration are preferred from the standpoint of productivity. The drying step is also not particularly limited, and freeze drying, flash jet drying, fluidized drying and vibrating fluidized drying are preferred from the standpoint of productivity.

The toner used in the method for forming an image according to the invention preferably has a volume average particle diameter D50 of from 3.0 to 5.0 μm, and more preferably from 3.0 to 4.5 μm. In the case where D50 is less than 3.0 μm, there are some cases where the charging property becomes insufficient to deteriorate the developing property, and in the case where it exceeds 4.8 μm, the uniformity of the image is impaired.

The toner used in the method for forming an image according to the invention preferably has a volume average particle size distribution index GSDv of 1.20 or less. In the case where GSDv exceeds 1.20, the resolution is lowered, which causes scattering of the toner and image defects, such as fogging.

The toner can be produced in the following manner. The resin particle dispersion liquid, the colorant particle dispersion liquid and the releasing agent particle dispersion liquid are separately prepared and mixed with each other at prescribed proportions, and a polymer of a metallic salt is added thereto under stirring to neutralize ionically for forming aggregated particles. Thereafter, an inorganic hydroxide is added to the system to adjust the pH in the system from weak acidity to neutral, and then the system is heated to a temperature higher than the glass transition point of the resin particles to attain fusion and integration. After completing the reaction, steps for sufficient washing, solid-liquid separation and drying are carried out to obtain the target toner.

According to the method for forming an image of the invention, such a color image with high quality and high grade can be formed that is excellent in fixing property, causes less amount of image defects, is suitable for graphic arts and short run printing, and has stably a wide color reproduction range.

(Image Forming Apparatus)

Figure 3:
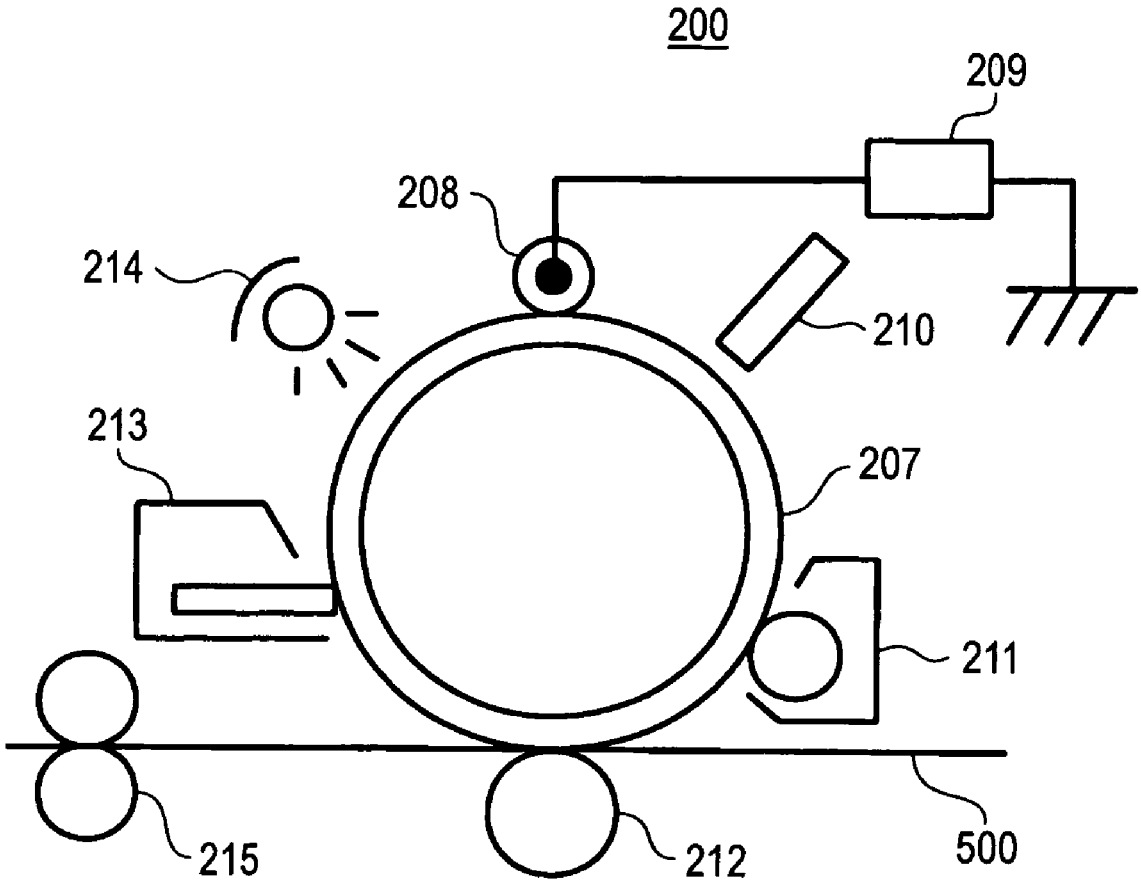
FIG. 3 is a schematic constitutional view showing an image forming apparatus according to an embodiment of the invention.

FIG. 3 is a schematic constitutional view showing an image forming apparatus according to a preferred embodiment of the invention. The image forming apparatus 200 shown in FIG. 3 has an electrophotographic photoreceptor 207, a charging unit 208 for charging the electrophotographic photoreceptor 207, an electric power source 209 connected to the charging unit 208, an exposure unit 210 for exposing the electrophotographic photoreceptor 207 which has been charged by the charging unit 208 to form an electronic latent image, a developing unit 211 for developing the electronic latent image which has been formed by the exposure unit 210 with a toner of the invention to form a toner image, a transferring unit 212 for transferring the toner image, which has been formed by the developing unit 211, to a recording medium 500, a cleaning unit 213, a destaticizing unit 214, and a fixing roll 215.

The charging unit 208 shown in FIG. 3 charges the surface of the photoreceptor 207 to a prescribed potential by making a contact type charging member (for example, a charging roll) into contact with the surface of the photoreceptor 207 to apply a voltage uniformly to the photoreceptor.

As the contact type charging member, such a member having a roller form can be preferably used that has a core material having provided on an outer periphery thereof an elastic layer, a resistor layer, a protective layer and the like. The shape of the contact type charging member may be either a brush form, a blade form, a pin electrode form or the like, in addition to the aforementioned roller form, and can be arbitrarily selected depending on the specification and the form of the image forming apparatus.

The material for the core material of the contact type charging member having a roller form may be a conductive material, such as iron, copper, brass, stainless steel, aluminum and nickel. A resin molded material having conductive particles dispersed therein may also be used as the core material. The material for the elastic layer may be a material exhibiting conductivity or semiconductivity, such as a rubber material having conductive particles or semiconductive particles dispersed therein. The materials for the resistor layer and the protective layer may be a binder resin having been controlled in resistance thereof by dispersing conductive particles or semiconductive particles therein.

A voltage is applied to the contact type charging member upon charging the photoreceptor by using the contact type charging member, and the voltage thus applied may be a direct current voltage or a direct current voltage having an alternate current voltage overlapped thereon.

A non-contact type charging member, such as a corotron and a scorotron, may be used instead of the contact type charging member shown in FIG. 3. The charging member may be arbitrarily selected depending on the specification and the form of the image forming apparatus.

The exposure unit 210 include an optical system device capable of imagewise exposing the surface f the electrophotographic photoreceptor by using a light source, such as a semiconductor laser, an LED (light emitting diode) and a liquid crystal shutter.

The developing unit 211 uses a toner of the invention as a developer. The toner used in the developing unit 211 preferably has a volume average particle of μm or less. More preferably, the toner is a crystalline toner having 0.02 log (Pa)/° C. or less of a gradient of a storage elasticity per temperature in a temperature range of from Tm+20° C. to Tm+50° C., where Tm represents a melting temperature of a crystalline resin contained in the crystalline toner, and Pa represents pressure and is in unit of $N/m^2$.

The transferring unit 212 include a contact type charging member having a roller form, and also include a contact type transfer charging device using a belt, a film, a rubber blade or the like, and a scorotron transfer charging device or a corotron transfer charging device utilizing corona discharge. The transferring unit 212 preferably transfers a toner to a recording medium as a toner image having monochromatic maximum toner mass per area of 3.5 $g/m^2$ or less.

The cleaning unit 213 is provided for removing the remaining toner attached to the surface of the electrophotographic photoreceptor after the transferring step. The electrophotographic photoreceptor having a surface thus cleaned by the cleaning unit is then repeatedly subjected to the aforementioned image forming process. The cleaning unit include a cleaning blade, and also include a cleaning brush and a cleaning roll, and among these, a cleaning blade is preferably used. A material for the cleaning blade include urethane rubber, neoprene rubber and silicone rubber.

The fixing roll 215 fixes the toner image at a surface of the fixing roll. In the fixing, temperature of the surface of the fixing roll is preferably equal to or less than 130° C.

The aforementioned embodiment of the image forming apparatus has only one image forming unit, and an image forming apparatus according to another embodiment may be a tandem type image forming apparatus having plural image forming units.

For example, in the case where four image forming units are contained, color toners of four colors, i.e., yellow, magenta, cyan and black, may be used in the four developing units of the image forming units, respectively. The tandem type image forming apparatus preferably contains a belt for conveying a recording medium commonly to the four image forming units, a conveying unit for conveying the belt, a toner feeding unit for feeding toners to the developing units, respectively, and a fixing roll for fixing a color toner image to the recording medium. In alternative, the tandem type image forming apparatus preferably contains an intermediate transfer material applied commonly to the four image forming units, a conveying unit for conveying the intermediate transfer material, a toner feeding unit for feeding toners to the developing units, respectively, a primary transfer unit for sequentially transferring images formed in the respective image forming units to the intermediate transfer material, a secondary transfer unit for transferring the color toner images on the intermediate transfer material to a recording medium at a time, a fixing roll for fixing the color toner images thus transferred to the recording medium.

EXAMPLE

The invention will be described in detail with reference to the following example, but the invention is not construed as being limited thereto.

The volume average particle diameter D50 and the average particle size distribution index are obtained in the following manner. The particle size distribution is measured by a particle size distribution measurement device, such as Coulter Counter TAII (produced by Beckmann-Coulter Co., Ltd.) or Multisizer II (produced by Beckmann-Coulter Co., Ltd.), and divided into plural particle size ranges (channels). Accumulated distributions of the volume and the numbers of the particles are drawn from the small diameter side of the channels. The particle diameter at an accumulation of 16% in terms of volume is designated as D16v, that in terms of number is designated as D16p, the particle diameter at an accumulation of 50% in terms of volume is designated as D50v, that in terms of number is designated as D50p, the particle diameter at an accumulation of 84% in terms of volume is designated as D84v, and that in terms of number is designated as D84p. The volume average particle size distribution index GSDv is calculated as $(D84v/D16v)^{1/2}$, and the number average particle size distribution index GSDp is calculated as $(D84p/D16p)^{1/2}$.

The toner used in the method for forming an image according to the invention generally has a shape factor SF1 of from 100 to 140, and preferably from 110 to 135, from the standpoint of image forming property. The shape factor SF1 in the invention can be obtained in the following manner. An optical micrograph of the toner spread on slide glass is imported into Luzex Image Analyzer through a video camera, and the maximum length (ML) and the projected area (A) are measured for 50 or more toner particles. The shape factor SF1 of the toner is calculated as (square of circumferential length)/(projected area)$=ML^2/A\times\pi/4\times100$.

[Measurement of Melting Point]

The melting point (Tm) of the crystalline polyester resin is measured in the following manner.

The melting point (Tm) is measured by using a thermal analyzer of a differential scanning calorimeter (DSC3110 Thermal Analyzing System 001, produced by MAC Science Co., Ltd.) (hereinafter, referred to as DSC). The measurement is carried out from room temperature to 150° C. with a temperature increasing rate of 10° C. per minute to obtain the melting point through analysis according to JIS K7121.

The endothermic peaks of the crystalline polyester resin each has a half value width of 6° C. or less, which reveals that the resin has crystallinity. An amorphous polymer has no clear melting point and is shown with a glass transition point (Tg).

[Measurement of Viscoelasticity]

The toner is measured for viscoelasticity in the following manner.

The viscoelasticity is measured by using a rotation flat-plate rheometer (RDA 2RHIOS System Ver. 4.3.2, produced by Rheometric Scientific FE Co., Ltd.).

An electrophotographic toner to be measured is set in a sample holder, and the measurement is carried out at a temperature increasing rate of 1° C. per min, a frequency of 1 rad/sec, a distortion of 20% or less, and a detection torque within the measurement compensation value. Sample holders having diameters of 8 mm and 20 mm are used depending on necessity.

What is specifically measured is a change of the storage elasticity GL with respect to the change in temperature. The value of $|\log GL(Tm+20)-\log GL(Tm+50)|/30$ is calculated by using the change of the storage elasticity GL with respect to the change in temperature thus obtained.

[Preparation of Crystalline Polyester Resin Dispersion Liquid (1)]

An acid component containing 92.5% by mole of dimethyl sebacate and 7.5% by mole of 5-t-butylisophthalic acid, ethylene glycol (in an amount of twice by mole the amount of the acid component) and Ti $(OBu)_4$ as a catalyst (in an amount of 0.012% by weight based on the acid components) are placed in a three-neck flask having been dried under heat, and the interior air of the flask is depressurized and replaced with nitrogen gas to make an inert atmosphere. The mixture is refluxed at 180° C. for 5 hours under mechanical stirring. Thereafter, excessive ethylene glycol is removed by distillation under reduced pressure, and the system is gradually increased in temperature to 220° C., followed by stirring for 2 hours. After obtaining a viscous state, the molecular weight is confirmed with GPC, and at the time when the weight average molecular weight reaches 12,000, distillation under reduced pressure is terminated, followed by cooling with air, to obtain crystalline polyester (1).

80 parts by weight of the crystalline polyester (1) and 720 parts by weight of deionized water are placed in a stainless steel beaker and heated to 95° C. over a hot bath. After melting the crystalline polyester resin, the system is stirred at 8,000 rpm by using a homogenizer (Ultra-Turrax T50, produced by IKA Works, Inc.). Emulsification and dispersion are carried out with 20 parts by weight of an aqueous solution obtained by diluting 1.6 parts by weight of an anionic surfactant (Neogen RK, produced by Daiichi Kogyo Seiyaku Co., Ltd.) added dropwise thereto, so as to prepare a crystalline polyester resin dispersion liquid (1) having an average particle diameter of 0.15 μm and a resin particle concentration of 10% by weight.

[Preparation of Crystalline Polyester Resin Dispersion Liquid (2)]

An acid component containing 85% by mole of dimethyl sebacate and 15% by mole of n-octadecenylsuccinic anhydride, ethylene glycol (in an amount of 1.5 times by mole the amount of the acid component) and Ti $(OBu)_4$ as a catalyst (in an amount of 0.012% by weight based on the acid components) are placed in a three-neck flask having been dried under heat, and the interior air of the flask is depressurized and replaced with nitrogen gas to make an inert atmosphere. The mixture is refluxed at 180° C. for 6 hours under mechanical stirring. Thereafter, excessive ethylene glycol is removed by distillation under reduced pressure, and the system is gradually increased in temperature to 220° C., followed by stirring for 3 hours. After obtaining a viscous state, the molecular weight is confirmed with GPC, and at the time when the weight average molecular weight reaches 22,000, distillation under reduced pressure is terminated, followed by cooling with air, to obtain crystalline polyester (2).

80 parts by weight of the crystalline polyester (2) and 720 parts by weight of deionized water are placed in a stainless steel beaker and heated to 95° C. over a hot bath. After melting the crystalline polyester resin, the system is stirred at 8,000 rpm by using a homogenizer (Ultra-Turrax T50, produced by IKA Works, Inc.). Emulsification and dispersion are carried out with 20 parts by weight of an aqueous solution obtained by diluting 1.6 parts by weight of an anionic surfactant (Neogen RK, produced by Daiichi Kogyo Seiyaku Co., Ltd.) added dropwise thereto, so as to prepare a crystalline polyester resin dispersion liquid (2) having an average particle diameter of 0.16 μm and a resin particle concentration of 10% by weight.

[Preparation of Crystalline Polyester Resin Dispersion Liquid (3)]

An acid component containing 90.5% by mole of 1,10-dodecanedioic acid, 2% by mole of sodium dimethyl 5-sulfoisophthalate and 7.5% by mole of 5-t-butylisophthalic acid, 1,9-nonanediol (in the same molar amount as the acid component) and Ti $(OBu)_4$ as a catalyst (in an amount of 0.014% by weight based on the acid components) are placed in a three-neck flask having been dried under heat, and the interior air of the flask is depressurized and replaced with nitrogen gas to make an inert atmosphere. The mixture is refluxed at 180° C. for 6 hours under mechanical stirring. Thereafter, excessive ethylene glycol is removed by distillation under reduced pressure, and the system is gradually increased in temperature to 220° C., followed by stirring for 2 hours. After obtaining a viscous state, the molecular weight is confirmed with GPC, and at the time when the weight average molecular weight reaches 11,000, distillation under reduced pressure is terminated, followed by cooling with air, to obtain crystalline polyester (3).

80 g of the crystalline polyester (3) and 720 g of deionized water are placed in a stainless steel beaker and heated to 95° C. over a hot bath. After melting the crystalline polyester resin, the system is stirred at 8,000 rpm by using a homogenizer (Ultra-Turrax T50, produced by IKA Works, Inc.). Emulsification and dispersion are carried out with 20 g of an aqueous solution obtained by diluting 1.6 g of an anionic surfactant (Neogen RK, produced by Daiichi Kogyo Seiyaku Co., Ltd.) added dropwise thereto, so as to prepare a crystalline polyester resin dispersion liquid (3) having an average particle diameter of 0.15 μm and a resin particle concentration of 10% by weight.

[Preparation of Crystalline Polyester Resin Dispersion Liquid (4)]

80 g of polycaprolactone, Placcel H1P (weight average molecular weight: 10,000, melting point: 60° C.) and 720 g of deionized water are placed in a stainless steel beaker and heated to 95° C. over a hot bath. After melting the polycaprolactone, the system is stirred at 8,000 rpm by using a homogenizer (Ultra-Turrax T50, produced by IKA Works, Inc.). Emulsification and dispersion are carried out with 20 g of an aqueous solution obtained by diluting 1.6 g of an anionic surfactant (Neogen RK, produced by Daiichi Kogyo Seiyaku Co., Ltd.) added dropwise thereto, so as to prepare a crystalline polyester resin dispersion liquid (4) having an average particle diameter of 0.15 μm and a resin particle concentration of 10% by weight.

[Preparation of Amorphous Resin Particle Dispersion Liquid (1)]

| | |
|---|---|
| Styrene | 480 parts by weight |
| n-Butyl acrylate | 120 parts by weight |
| Acrylic acid | 12 parts by weight |
| Dodecanethiol | 12 parts by weight |

The aforementioned components are mixed and dissolved to prepare a solution.

Separately, 12 parts by weight of an anionic surfactant (Dowfax, produced by Dowchemical Inc.) is dissolved in 250 parts by weight of ion exchanged water, to which the aforementioned solution is added, followed by subjecting to dispersion and emulsification in a flask to obtain a monomer emulsion A.

1 part by weight of an anionic surfactant (Dowfax, produced by Dowchemical, Inc.) is dissolved in 555 parts by weight of ion exchanged water and charged in a polymerization flask.

After sealing the polymerization flask, a reflux tube is attached. The polymerization flask is heated to 75° C. over a water bath and maintained at the temperature with nitrogen being charged under slowly stirring.

9 parts by weight of ammonium persulfate is dissolved in 43 parts by weight of ion exchanged water, and the resulting solution is added dropwise to the polymerization flask over 20 minutes through a metering pump. The monomer emulsion A is then added dropwise thereto over 200 minutes through a metering pump.

Thereafter, the polymerization flask is maintained at 75° C. for 3 hours under slowly stirring to complete polymerization.

According to the foregoing procedures, an a ionic resin particle dispersion liquid (1) having a center diameter of the particles of 240 nm, a glass transition point of 54° C., a weight average molecular weight of 25,000, and a solid content of 42% is obtained.

[Preparation of Amorphous Resin Particle Dispersion Liquid (2)]

An anionic resin particle dispersion liquid (2) having a center diameter of the particles of 210 nm, a glass transition point of 51° C., a weight average molecular weight of 20,000, and a solid content of 42% is obtained in the same manner as in the preparation of the amorphous resin particle dispersion liquid (1) except that the amount of acrylic acid is changed to 9 parts by weight, and the amount of the dodecanethiol is changed to 15 parts by weight.

[Preparation of Colorant Particle Dispersion Liquid (1)]

| | |
|---|---|
| Yellow pigment (C.I.Pigment Yellow 74, produced by Clariant Japan Co., Ltd.) | 50 parts by weight |
| Anionic surfactant (Neogen R, produced by Daiichi Kogyo Seiyaku Co., Ltd.) | 5 parts by weight |
| Ion exchanged water | 200 parts by weight |

The aforementioned components are mixed and dissolved, and the mixture is dispersed by using a homogenizer (Ultra-Turrax T50, produced by IKA Works, Inc.) to obtain a yellow colorant particle dispersion liquid (1) having a center diameter of 200 nm and solid content of 21.5%.

[Preparation of Colorant Particle Dispersion Liquid (2)]

A cyan colorant particle dispersion liquid (2) having a center diameter of 190 nm and a solid content of 21.5% is obtained in the same manner as in the preparation of the colorant particle dispersion liquid (1) except that a cyan pigment (Copper Phthalocyanine B15:3, produced by Dainichiseika Color and Chemicals Mfg. Co., Ltd.) is used instead of the yellow pigment.

[Preparation of Colorant Particle Dispersion Liquid (3)]

A magenta colorant particle dispersion liquid (3) having a center diameter of 160 nm and a solid content of 21.5% is obtained in the same manner as in the preparation of the colorant, particle dispersion liquid (1) except that a magenta pigment (C.I. Pigment Red 122, produced by Dainippon Ink and Chemicals, Inc.) is used instead of the yellow pigment.

[Preparation of Colorant Particle Dispersion Liquid (4)]

A magenta colorant particle dispersion liquid (4) having a center diameter of 170 nm and a solid content of 21.5% is obtained in the same manner as in the preparation of the colorant particle dispersion liquid (1) except that a black pigment (carbon black, produced by Cabot Oil and Gas Corp.) is used instead of the yellow pigment.

[Preparation of Releasing Agent Particle Dispersion Liquid]

| | |
|---|---|
| HNP09 (produced by Nippon Seiro Co., Ltd., melting point: 75° C.) | 50 parts by weight |
| Anionic surfactant (Dowfax, produced by Dowchemical, Inc.) | 5 parts by weight |
| Ion exchanged water | 200 parts by weight |

The aforementioned components are sufficiently dispersed by using a homogenizer (Ultra-Turrax T50, produced by IKA Works, Inc.) under heating to 110° C., and then dispersed by using a pressure discharge homogenizer (Gorin Homogenizer, produced by Gorin, Inc.) to obtain a releasing agent particle dispersion liquid having a center diameter of 120 nm and a solid content of 21.0%.

Example 1

Preparation of Crystalline Toner Particles (1)

(Preparation of Crystalline Toner Particles)

| | |
|---|---|
| Crystalline resin particle dispersion liquid (1) | 331 parts by weight (resin: 33.1 parts by weight) |

-continued

| | |
|---|---|
| Amorphous resin particle dispersion liquid (1) | 52 parts by weight (resin: 21.84 parts by weight) |
| Colorant particle dispersion liquid (1) | 39.5 parts by weight (pigment: 8.5 parts by weight) |
| Releasing agent particle dispersion liquid | 38.1 parts by weight (releasing agent: 8 parts by weight) |
| Polyaluminum chloride | 0.14 part by weight |

The aforementioned components are sufficiently mixed and dispersed in a stainless steel round-bottom flask by using a homogenizer (Ultra-Turrax T50, produced by IKA Works, Inc.). The content of the flask is then heated to 43° C. over a heating oil bath under stirring the content and maintained at 48° C. for 60 minutes. 68 parts by weight (resin: 28.56 parts by weight) of the amorphous resin particle dispersion (1) is then gradually added and stirred. Thereafter, the temperature is increased to 45° C. and maintained at that temperature for 120 minutes. It is then confirmed by using a particle size distribution measurement device that the particle size distribution is further narrowed.

Thereafter, the pH of the system is adjusted to 6.5 with a sodium hydroxide aqueous solution having a concentration of 0.5 mole/L, and then the system is heated to 95° C. under continuously stirring.

While the pH of the system is generally lowered to 5.2 during the period where the temperature is increased to 95° C., the pH is maintained. After completing the reaction, the system is cooled, filtered and sufficiently washed with ion exchanged water, and is then subjected to solid-liquid separation by Nutsche suction filtration. The solid content is again dispersed in 3 L of ion exchanged water at 40° C. and washed therein by stirring at 300 rpm for 15 minutes. The washing operation is repeated in 5 times, and the solid content is subjected to solid-liquid separation by Nutsche suction filtration and then dried in vacuum for 12 hours to obtain crystalline toner particles.

The measurement of the crystalline toner particles with a particle size distribution measurement device such as Coulter Counter reveals that the toner particles have a volume average particle diameter D50 of 4.5 μm, a volume average particle diameter distribution index GSDv of 1.19, and a surface property index of 1.50. The shape factor SF1 of the crystalline toner particles obtained by shape observation with a Luzex image analyzer is 125, which indicates a spherical shape.

5 parts by weight of hydrophobic silica (TS720, produced by Cabot Oil and Gas Corp.) is added to 50 parts by weight of the crystalline toner particles, and mixed in a sample mill to obtain an externally added toner.

A ferrite carrier having 1% of polymethyl methacrylate (produced by Soken Chemical Co., Ltd.) coated thereon having an average particle diameter of 50 μm and the externally added toner are stirred and mixed in a ball mill for 5 minutes to make a toner concentration of 5%, and thus a developer is obtained.

Example 2

Preparation of Crystalline Toner Particles (2)

Crystalline toner particles (2) are obtained in the same manner as in the preparation of the crystalline toner particles (1) except that the crystalline resin particle dispersion liquid (1) is changed to the crystalline resin particle dispersion liquid (2), the colorant particle dispersion liquid (1) is changed to the colorant particle dispersion liquid (2), and the pH upon heating to 95° C. is maintained at 4.0, in Example 1.

The crystalline toner particles have a volume average particle diameter D50 of 4.30 μm, a volume average particle diameter distribution index GSDv of 1.20, and a surface property index of 1.42. The shape factor SF1 thereof is 120, which indicates a spherical shape.

An externally added toner is obtained by using the crystalline toner particles thus obtained, and then a developer is prepared therefrom, in the same manner as in Example 1.

Example 3

Preparation of Crystalline Toner Particles (3)

Crystalline toner particles (3) are obtained in the same manner as in the preparation of the crystalline toner particles (2) except that the crystalline resin particle dispersion liquid (2) is changed to the crystalline resin particle dispersion liquid (3), the colorant particle dispersion liquid (2) is changed to the colorant particle dispersion liquid (3), the amount of the colorant particle dispersion liquid is increased by 0.5 part by weight, the maximum temperature for aggregation is changed to 42° C., and the pH upon heating to 95° C. is maintained at a constant value of 3.8, in the preparation of the crystalline toner particles (2).

The crystalline toner particles have a volume average particle diameter D50 of 4.2 μm, a volume average particle diameter distribution index GSDv of 1.18, and a surface property index of 1.30. The shape factor SF1 thereof is 118, which indicates a spherical shape.

An externally added toner is obtained by using the crystalline toner particles thus obtained, and then a developer is prepared therefrom, in the same manner as in Example 1.

Example 4

Preparation of Crystalline Toner Particles (4)

Crystalline toner particles (4) are obtained in the same manner as in the preparation of the crystalline toner particles (2) except that the crystalline resin particle dispersion liquid (3) is changed to the crystalline resin particle dispersion liquid (4), the amount of the colorant particle dispersion liquid (2) is increased by 1.5 parts by weight, and the pH upon heating to 95° C. is maintained at a constant value of 3.8, in the preparation of the crystalline toner particles (2).

The crystalline toner particles have a volume average particle diameter D50 of 3.8 μm, a volume average particle diameter distribution index GSDv of 1.15, and a surface property index of 1.25. The shape factor SF1 thereof is 115, which indicates a spherical shape.

An externally added toner is obtained by using the crystalline toner particles thus obtained, and then a developer is prepared therefrom, in the same manner as in Example 1.

Example 5

Preparation of Crystalline Toner Particles (5)

Crystalline toner particles (5) are obtained in the same manner as in the preparation of the crystalline toner particles (1) except that the amorphous resin particle dispersion liquid (1) is changed to the amorphous resin particle dispersion liquid (2), the amount of the pigment dispersion as a toner is increased by 1.5 parts by weight, the maximum temperature for aggregation is changed to 42° C., and the pH upon heating to 95° C. is maintained at a constant value of 4.0, in the preparation of the crystalline toner particles (1).

The crystalline toner particles have a volume average particle diameter D50 of 4.5 μm, a volume average particle diameter distribution index GSDv of 1.20, and a surface property index of 1.40. The shape factor SF1 thereof is 120, which indicates a spherical shape.

An externally added toner is obtained by using the crystalline toner particles thus obtained, and then a developer is prepared therefrom, in the same manner as in Example 1.

Example 6

Preparation of Crystalline Toner Particles (6)

Crystalline toner particles (6) are obtained in the same manner as in the preparation of the crystalline toner particles (2) except that the amorphous resin particle dispersion liquid (1) is changed to the amorphous resin particle dispersion liquid (2), the maximum temperature for aggregation is changed to 42° C., and the pH upon heating to 95° C. is maintained at a constant value of 4.0, in the preparation of the crystalline toner particles (4).

The crystalline toner particles have a volume average particle diameter D50 of 4.5 μm, a volume average particle diameter distribution index GSDv of 1.19, and a surface property index of 1.38. The shape factor SF1 thereof is 120, which indicates a spherical shape.

An externally added toner is obtained by using the crystalline toner particles thus obtained, and then a developer is prepared therefrom, in the same manner as in Example 1.

Comparative Example 1

Preparation of Comparative Toner Particles (1)

Comparative toner particles (1) are obtained in the same manner as in Example 1 except that the amount of the pigment dispersion (2) as a toner is reduced by 1.5 parts by weight, and the pH upon heating to 95° C. is maintained at 5.5, in Example 1. The toner particles have a volume average particle diameter D50 of 4.8 μm, a volume average particle diameter distribution index GSDv of 1.22, a surface property index is 2.05, and a shape factor SF1 of 120, which indicates a somewhat irregular shape.

Comparative Example 2

Preparation of Comparative Toner Particles (2)

Comparative toner particles (2) are obtained in the same manner as in Example 1 except that the crystalline resin particle dispersion liquid is not used but only the amorphous resin particle dispersion (1) is used, the amount of the pigment dispersion (2) as a toner is reduced by 1.5 parts by weight, and the pH upon heating to 95° C. is maintained at 4.0, in Example 1. The toner particles have a volume average particle diameter D50 of 5.5 μm, a volume average particle diameter distribution index GSDv of 1.21, a surface property index is 1.80, and a shape factor SF1 of 125, which indicates a spherical shape.

<Actual Device Evaluation>

The developers are evaluated by using a modified machine of DocuCentre1250 with C2 Paper, produced by Fuji Xerox Co., Ltd., used as transfer paper. The process speed is changed from 25 mm/sec to 240 mm/sec, the fixing roll of the fixing device is modified to an oilless fixing device using a PFA roll, and the fixing nip width is varied within a range of from 4 to 12 mm. The fixing temperature (the surface temperature of the fixing roll) is varied within a range of from 90 to 140° C., and the evaluation is carried out with a toner mass per area being varied under monitoring.

(Transfer Paper)

The transfer paper is used after seasoning by storing in a chamber at 28° C., 85% RH for 24 hours.

<Evaluation of Dropout of Character Line Image>

The developers thus obtained each is installed in a color image forming apparatus (modified machine of DC1250, produced by Fuji Xerox Co., Ltd.), and image formation is carried out. Characters and a line image are evaluated in the following standard with a monochromatic toner mass per area per unit area being varied.

AA: Excellent with no occurrence of dropout
A: Good with no occurrence of dropout
B: Allowable with slight dropout
C: Problems in image quality with occurrence of dropout <Evaluation of Scattering of Line Image>

The developers thus obtained each is installed in a color image forming apparatus (modified machine of DocuCentre1250, produced by Fuji Xerox Co., Ltd.), and image formation is carried out. Scattering of a line image is evaluated in the following standard with a monochromatic toner mass per area being varied.

AA: Excellent with no occurrence of scattering
A: Good with no occurrence of scattering
B: Allowable with slight scattering
C: Problems in image quality with occurrence of scattering <Evaluation of Roughness in Image>

The developers thus obtained each is installed in a color image forming apparatus (modified machine: of DC1250, produced by Fuji Xerox Co., Ltd.), and image formation is carried out. Roughness in an image is evaluated in the following standard with a monochromatic toner mass per area being varied.

AA: Excellent with no occurrence of roughness
A: Good with no occurrence of roughness
B: Allowable with slight roughness
C: Problems in image quality with occurrence of roughness The evaluation results are shown in Table 1 below.

TABLE 1

| | Example 1 | Example 2 | Example 3 | Example 4 |
|---|---|---|---|---|
| Crystalline resin dispersion liquid | 1 | 2 | 3 | 4 |
| Amorphous resin dispersion liquid | 1 | 1 | 1 | 1 |
| Pigment dispersion liquid | 1 | 2 | 3 | 2 |
| Amount of pigment (%) | 8.5 | 8.5 | 9 | 10 |
| Releasing agent dispersion liquid | 1 | 1 | 1 | 1 |

TABLE 1-continued

| | | | | |
|---|---|---|---|---|
| Melting point of binder resin (° C.) | 75 | 74 | 72 | 60 |
| Particle diameter (μm) | 4.5 | 4.3 | 4.2 | 3.8 |
| GSDv | 1.19 | 1.20 | 1.18 | 1.15 |
| Shape factor SF1 | 125 | 120 | 118 | 115 |
| Surface property index | 1.50 | 1.42 | 1.30 | 1.25 |
| Gradient of storage elasticity (log(Pa)/° C.) | 0.019 | 0.018 | 0.015 | 0.018 |
| Toner mass per area (mg/cm$^2$) | 0.35 | 0.35 | 0.30 | 0.25 |
| Fixing time (ms) | 52 | 52 | 100 | 480 |
| Fixing temperature (° C.) | 115 | 120 | 110 | 95 |
| Dropout of characters and line image | A | A | A | A |
| Scattering of line image | A | A | AA | AA |
| Roughness in image | A | A | A | AA |

| | Example 5 | Example 6 | Comparative Example 1 | Comparative Example 2 |
|---|---|---|---|---|
| Crystalline resin dispersion liquid | 1 | 4 | 1 | — |
| Amorphous resin dispersion liquid | 2 | 2 | 1 | 1 |
| Pigment dispersion liquid | 2 | 2 | 2 | 2 |
| Amount of pigment (%) | 10 | 10 | 7 | 7 |
| Releasing agent dispersion liquid | 1 | 1 | 1 | 1 |
| Melting point of binder resin (° C.) | 75 | 60 | 75 | (Tg: 51) |
| Particle diameter (μm) | 4.5 | 4.5 | 4.8 | 5.5 |
| GSDv | 1.20 | 1.19 | 1.22 | 1.21 |
| Shape factor SF1 | 120 | 120 | 130 | 125 |
| Surface property index | 1.40 | 1.38 | 2.05 | 1.80 |
| Gradient of storage elasticity (log(Pa)/° C.) | 0.015 | 0.015 | 0.02 | 0.03 |
| Toner mass per area (mg/cm$^2$) | 0.30 | 0.30 | 0.42 | 0.30 |
| Fixing time (ms) | 100 | 200 | 40 | 100 |
| Fixing temperature (° C.) | 120 | 110 | 115 | 135 |
| Dropout of characters and line image | A | A | B | B |
| Scattering of line image | A | A | C | B |
| Roughness in image | A | A | B | C |

Figure 2:
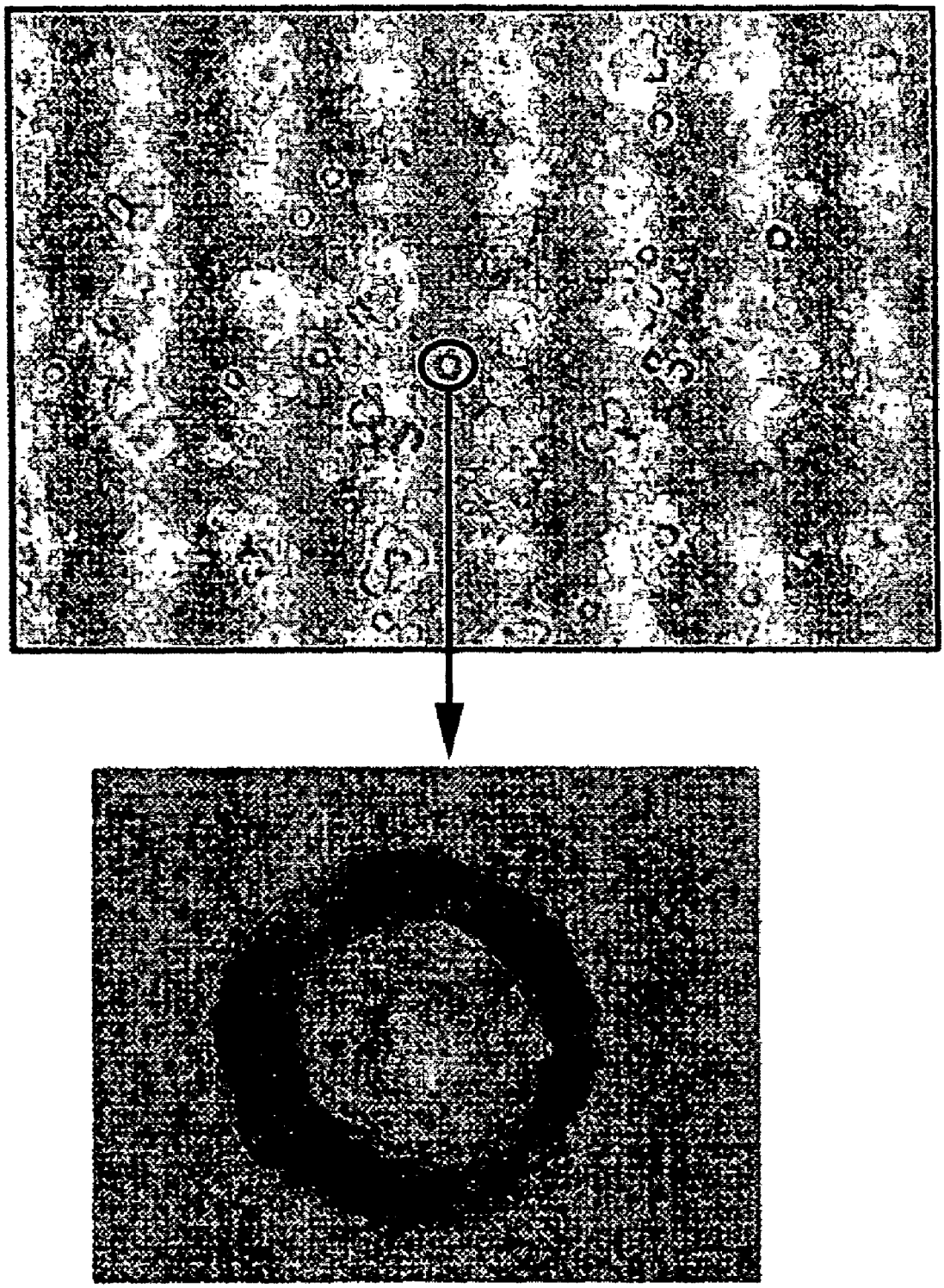
FIG. 2 is an observed image of blister occurring in the image of Comparative Example 2.

Blister is not observed in the images formed by using the developers of Examples 1 to 6, but is observed in the images formed by using the developers of Comparative Examples 1 and 2. FIG. 2 shows an observed image of blister occurring in the image formed by using the developer of Comparative Example 2.

What is claimed is:

1. A method for forming an image comprising:

transferring a toner having a volume average particle diameter of 5 μm or less to a transfer medium as a toner image having a monochromatic maximum toner mass per area of 3.5 g/m$^2$ or less; and fixing the toner image at a surface temperature of a fixing roll which is equal to or less than 130° C., wherein the toner is a crystalline toner having 0.02 log(Pa)/° C. or less of a gradient of a storage elasticity per temperature in a temperature range of from Tm+20° C. to Tm+50° C., where Tm represents a melting temperature of a crystalline resin contained in the crystalline toner, and Pa represents pressure and is in unit of N/m$^2$.

2. The method according to claim 1, wherein the toner contains a self-water dispersible resin.

3. The method according to claim 1, wherein the toner contains crystalline polyester.

4. The method according to claim 1, wherein the toner has a shape factor SF1 of from 100 to 140 and the shape factor SF1 is defined by $$SF1=(ML^2/A)\times(\pi/4)\times 100$$

where ML represents a maximum length of the toner, and A represents a projected area of the toner.

5. The method according to claim 1, wherein the toner is produced by a process comprising:

mixing at least one kind of a resin particle dispersion liquid and at least one kind of colorant dispersion liquid; and adding an aggregating agent thereto to form aggregated particles.

6. The method according to claim 1, wherein the toner has a volume average particle size distribution index GSDv of 1.20 or less and the volume average particle size distribution index GSDv is defined by $$GSDv=(D84v/D16v)^{1/2}$$

where D84v and D16v each represents a particle diameter showing of accumulation of 84% and 16% when accumulated distributions of volumes of the toner are drawn from a small diameter side of a channel of a particle size distribution measurement device.

7. The method according to claim 1, wherein the toner has a surface property index of 2.0 or less and the surface property index is defined by $$\text{(surface property index)}=\text{(measured specific surface area)/(calculated specific surface area)(calculated specific surface area)}=6\Sigma(n\times R^2)/(\rho\times\Sigma(n\times R^3))$$

where n represents the number of particles in a channel of a particle size distribution measurement device; R represents a diameter of the channel of the particle size distribution measurement device; and p represents a density of the toner.

8. The method according to claim 1, wherein the toner contains a releasing agent in an amount of from 5 to 25% by weight based on the total solid content of the toner.

9. The method according to claim 1, wherein the toner contains a colorant having a median particle diameter of from 100 to 330 nm.

10. The method according to claim 1, wherein the toner contains a colorant in an amount of 8% or more by weight based on the total solid content of the toner.

11. The method according to claim 1, wherein a fixing time in the fixing is of from 50 to 500 ms.

12. An image forming apparatus comprising:

a transferring unit which transfers a toner having a volume average particle diameter of 5 μm or less to a recording medium as a toner image having a monochromatic maximum toner mass per area of 3.5 $g/m^2$ or less; and a fixing roll which fixes the toner image at a surface of the fixing roll, wherein temperature of the surface of the fixing roll is equal to or less than 130° C., wherein the toner is a crystalline toner having 0.02 log(Pa)/° C. or less of a gradient of a storage elasticity per temperature in a temperature range of from Tm+20° C. to Tm+50° C., where Tm represents a melting temperature of a crystalline resin contained in the crystalline toner, and Pa represents pressure and is in unit of $N/m^2$.

13. The image forming apparatus according to claim 12, wherein a fixing time at the fixing roll is of from 50 to 500 ms.

* * * * *